US005227574A

United States Patent [19]

Mukaino

[11] Patent Number: 5,227,574

[45] Date of Patent: Jul. 13, 1993

[54] TEMPO CONTROLLER FOR CONTROLLING AN AUTOMATIC PLAY TEMPO IN RESPONSE TO A TAP OPERATION

[75] Inventor: Hirofumi Mukaino, Hamamatsu, Japan

[73] Assignee: Yamaha Corporation, Hamamatsu, Japan

[21] Appl. No.: 765,041

[22] Filed: Sep. 24, 1991

[30] Foreign Application Priority Data

Sep. 25, 1990 [JP] Japan ..... 2-255742
Oct. 19, 1990 [JP] Japan ..... 2-282852

[51] Int. Cl.[5] ..... G10H 1/40

[52] U.S. Cl. ..... 84/652; 84/668; 84/DIG. 12

[58] Field of Search ..... 84/612, 636, 652, 668, 84/714, 484, DIG. 12

[56] References Cited

U.S. PATENT DOCUMENTS 4,418,594 12/1983 Klynas ..... 84/DIG. 12
4,484,507 11/1984 Nakada et al. ..... 84/DIG. 12
4,630,518 12/1986 Usami ..... 84/DIG. 12

*Primary Examiner*—Stanley J. Witkowski
*Attorney, Agent, or Firm*—Graham & James

[57] ABSTRACT

When a tap switch is operated at desired beats during automatic music play, the tempo of the automatic play is variably controlled in correspondence with the interval between the tap operations. On the other hand, detection is made of a difference between the current score time at a tap switch operation time and the score time of a beat point corresponding to the tap switch operation time. Then, control is made for progressively changing the current score time in order to eliminate the detected score time difference. Thus, the score time difference is progressively eliminated in smooth manner, so that necessary notes can be sequentially sounded without being left out. The control for progressively changing the current score time may be performed in accordance with a predetermined function. Further, the control for progressively changing the current score time may be performed with a characteristic such that it is automatically changed in view of the number of notes in the automatic play.

11 Claims, 8 Drawing Sheets

TABLE 1

TIME DIFFERENCE ELIMINATION RATE DETERMINING TABLE

| TONE NO. 1 | TONE NO. 2 | ER |
|---|---|---|
| 0 | 1 or less | 100% |
| | 2 or more | 25% |
| 1 | 1 or less | 50% |
| | 2 or more | 75% |
| 2 or more | | 0% |

TABLE 1

TEMPO DIFFERENCE ELIMINATION AMOUNT DETERMINING TABLE

| TONE NO. 3 | TEMEA |
|---|---|
| 0 | 12 |
| 1 | 6 |
| 2 | 4 |
| 3 or more | 3 |

TEMPO CONTROLLER FOR CONTROLLING AN AUTOMATIC PLAY TEMPO IN RESPONSE TO A TAP OPERATION

BACKGROUND OF THE INVENTION

The present invention relates to a tempo controller for automatic music play that is capable of providing a sequencer, rhythm machine etc. with tempo clock data that is controlled on the real time basis.

The play tempo is without doubt one of the most essential factors of music, because the tempo plays a significant role in making up characteristic musical expression by being varied in various manners even during the play of a single piece of music. Such tempo variation includes, for example, general tempo change like retardando or accelerando and more minute tempo change like tempo swing within a measure. Musical expression like that obtained by natural musical instruments can be achieved by an electronic musical instrument, if such minute tempo change can be effectively provided thereby, particularly, in its automatic playing. To carry out automatic playing, for example, on a sequencer according to the conventional technique, such tempo expression is realized by previously inputting a desired expression in the form of data.

However, the conventional sequencer is not satisfactory in that it can not provide flexible tempo changes on the real time basis. This means that the sequencer is almost incapable with respect to synchronization in playing with a human player, and thus the human player has to adapt himself to the device. To solve this problem, a technique is proposed in accordance with which tempo clock data is, rather than being produced within the sequencer, given from outside and besides the tempo clock data is controlled on the real time basis. As the most fundamental means for providing tempo expression from outside, tapping may be used. Namely, the player can produce tempo clock data based on his making tapping action.

Now, it is considered with reference to FIGS. 7, 8, 9A, 9B, 10A and 10B how music play by a computer (electronic musical instrument such as a sequencer performing an automatic play) is controlled in response to a tempo given by tapping action. Before going into such consideration, the following definition of the terms, "physical time" and "score time" frequently used hereunder is given.

Physical Time: It means normal time that is measured with a unit of, for example, milli second and produced by a timer within the computer.

Score Time: It means a position in a musical score that is measured with a unit equivalent to a certain fraction of one beat. For example, as will be mentioned throughout of this specification, the score time can be represented with a unit which is equivalent to 1/384 of one beat. According to the MIDI (Musical Instrument Digital Instrument) standard, F8 (MIDI clock data) is interpreted as a unit score time equivalent to 1/24 of one beat.

It is now assumed that the play is proceeded while the computer is successively provided with tempo by tapping. It is also assumed that, in FIG. 7, the tap operator (a player) has actually made the first tap at a position A' corresponding to A. In FIG. 7, A', B' and C' represent timings of individual taps made by the player, and A, B and C represent score timings in the computer. At the first tap timing, the score time in the computer is in accurate synchronism with the physical time at which the tap has been effected. If the play proceeds on keeping the same tempo, the next accented beat or downbeat (i.e., a position at which the next tap should occur) should be at position B. However, if the player makes the next tap at position B' little earlier than position B in an attempt to step up the tempo, a score time difference (corresponding to $\frac{1}{4}$ of one beat in the illustrated example) is eventually be produced. Of course, a tempo difference is also be produced at this time. Thus, it becomes necessary to adjust the tempo for properly synchronizing the play by the computer with the play which the player wishes to perform. In this example, the tempo needs to be raised to 4/3 times. But, if nothing else is done, the next accented beat by the computer occurs at position C, while the player's next tap occurs at position C', so that the time difference ($\frac{1}{4}$ of one beat) is retained and hence complete synchronization is not attained.

Therefore, the time difference produced from tapping at position B' must be positively eliminated or corrected by some measures. The most simplest way to eliminate the time difference may be to forcibly adjust the computer's score time which is still at a position of $\frac{3}{4}$ halfway to the one beat position corresponding to position B', when the next tap has been made at position B'. Similarly, when a tap has been made at position C', the computer' score time is forcibly adjusted to a position corresponding to position C'. FIG. 8 illustrates the principle of this solution, according to which the player's play and the computer's play can completely be synchronized with each other for each beat. However, the solution has one problem that, since, as mentioned, the computer is still at a position of $\frac{3}{4}$ halfway to the one beat position when the next tap has been made at position B', sounding of notes contained between the $\frac{3}{4}$ position and the one beat position is undesirably effected at one time. If, for example, there is contained a qudruplet therebetween, it is sounded simultaneously to produce an effect unfavorable in musical sense. Of course, if there is no note therebetween, no such unfavorable effect is produced.

If expressed by the score time and physical time, the proposed technique illustrated in FIGS. 7 and 8 will be as shown in FIGS. 9A and 9B and in FIGS. 10A and 10B, in which the score time is represented with a unit time that is equivalent to 1/384 of one beat as mentioned throughout the specification.

FIGS. 9A and 9B show that at physical time position t3 a tap timing has been slightly advanced by the player. In this case, although the advanced tap timing causes the tempo to be little faster, there is produced at position t3 a delay in the score time that is equal to 14 (=384−370) units, namely, 14 clock data (individual clock data is hereafter referred to also as a clock. If the tempo is not subsequently changed, the delay (time lag) is retained. On the other hand, in FIGS. 10A and 10B, the score time of the third beat (score time position 1152) is adjusted to time t3 at the moment when a tap has been made in advanced manner at time t3. Therefore, notes corresponding to 14 clocks produced immediately before the third beat are sounded at one time. The same is true with the fourth tap position.

As has been mentioned above, the prior art technique is diadvantageous in that with a mere tempo adjustment or forcible adjustment of time lag alone, complete synchronization between the play and tapping can not be achieved, or plural notes tend to be sounded at one time, as a result of which there arise musical problems.

SUMMARY OF THE INVENTION

Therefore, it is an object of the invention to provide a tempo controller which allows a music play to smoothly follow a tap by eliminating a score time difference or time lag produced at the time of tapping in a certain function.

A tempo controller according to the invention comprises a section for producing tempo information to set a tempo of an automatic play, a tapping section for making a tap operation, a tempo controlling section for controlling the tempo information in correspondence with a tap operation performed by the tapping section, a score time advancing section for advancing the current score time indicative of the current score position in the automatic play at a tempo corresponding to the tempo information, a score time difference detecting means for detecting a difference between the current score time at the time of the tap operation performed by the tapping section and a score time of a beat point corresponding to the tap operation time, and a current score time controlling section for performing a control to progressively change the current score time in order to eliminate the score time difference detected by the detecting section.

When a tap operation is performed by the tapping section, the tempo information is controlled by the tempo controlling section. Then, the current score time indicative of the current score position in the automatic play is advanced at a tempo corresponding to the tempo information. Thus, tempo adjustment is made in correspondence with the tap operation. The arrangements mentioned above are similar to those employed in the conventional techniques, but the characteristic feature of the invention lies in having the score time difference detecting section and the current score time controlling section. That is, the score time difference detecting section detects a difference between the current score time at the time of a tap operation and a score time of a beat point corresponding to the tap operation time. The current score time controlling section performs a control to progressively change the current score time in an attempt to eliminate the detected score time difference. With such progressive change in the current score time, the difference between the current score time at the tap operation time and the score time of the beat point corresponding to the tap operation time is, instead of being eliminated at one time as in the conventional technique, progressively eliminated in smooth manner. Accordingly, plural notes are prevented from being sounded at one time in response to a tap operation, but instead, they can be sounded without being left out in accordance with the progressive change in the current score time.

The control for progressively changing the current score time may be performed in accordance with a desired function, in which case a parameter of the function may be variably set. For example, if a parameter is set as to enhance the convergency of the function, followability will be improved, but change in the current score time will be made relatively abrupt. On the other hand, if a parameter is set as to make the function convergency relatively low, followability will be degraded, but the change in the current score time will be carried out smoothly. Therefore, a parameter of the function can be variably set by the player as desired in view of the desired harmony or trade-off between followability and smoothness.

The control for progressively changing the current time may be done with a characteristic such that it can be automatically varied in view of the number of notes in the automatic play. In such case, for example, detection is made of a density of notes contained in the neighborhood of the score time position at the time of a tap operation, and then the control for progressively changing the current time is done with a characteristic corresponding to the detected note density. In this manner, followabity can be automatically obtained which corresponds to play conditions such as a type of music being actually played and the number of notes at the time of the tap operation. For example, if the note number is small, the control for progressively changing the score time is performed with a characteristic such that the score time difference can be eliminated at a rapid speed. In such case, change in the current score time is made relatively abrupt, but no musical problem arises because of the small note density, and good followability can be provided. On the other hand, if the number of notes is large, the control for progressively changing the current score time is done with a characteristic such that the score time difference is eliminated at a relatively slow speed. In such case, change in the current score time is made relatively slow, and thus poor followability is provided, but smooth change well fitted to play conditions can be realized because of the large note density.

Now, preferred embodiments of the invention will be described with reference to the accompanying drawings.

DETAILED DESCRIPTION OF THE PREFERRED EMBODIMENTS

Figure 1:
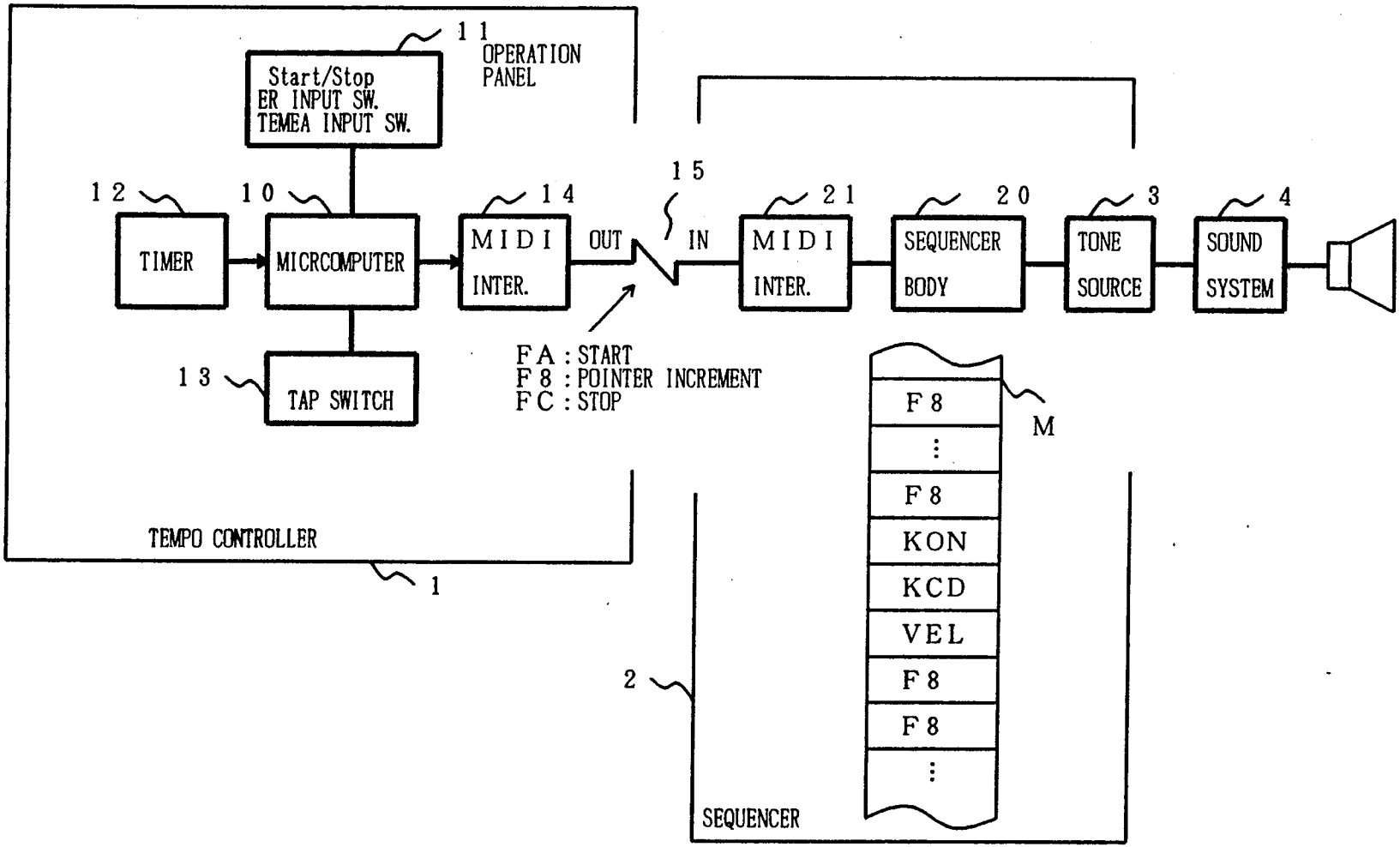
FIG. 1 is a block diagram showing an embodiment of the present invention, showing a tempo controller to which a sequencer, a tone source and a sound system are connected.

FIG. 1 is a block diagram showing an embodiment of the present invention, in which a reference character 1 denotes a tempo controller, 2 a sequencer, 3 a tone source and 4 a sound system. In a play data memory of the sequencer 2, play data are stored in advance. The tempo controller 1 functions to give tempo clock data to the sequencer 2 through a MIDI (Musical Instrument Digital Interface) cable. In fact, F8 data which is clock data prepared in the MIDI format is transmitted through the MIDI cable. In addition to F8 data, FA data is output from the tempo controller 1 at the start of playing, and FC data is output at the end of playing. Upon receipt of F8 data, the sequencer 2 increments a play data memory pointer by one; that is, the sequencer 2 reads play data out from the internal play data memory on the basis of the tempo clock data and then supplies the play data to the tone source 3. In response to this, the tone source 3 reads from a tone source memory wave form data corresponding to the supplied play data and outputs the wave form data to the sound system 4.

The tempo controller 1 comprises a microcomputer 10, an operation panel 11, a timer 12, a tap switch 13 and a MIDI interface 14. The operation panel 11 includes a start/stop switch, a switch for inputting an initial time difference elimination rate (ER) and a switch for inputting tempo difference elimination amount (TEMEA). The timer 12 is used as an external interruption timer. The tap switch 13 is a conventional ON/OFF switch. To facilitate the player's tapping action, it is preferable that the tap switch 13 is so constructed as to get turned on and off in response to upward and downward movements of a foot or a hand. On the basis of the tempo clock data output from the microcomputer 10, the MIDI interface 14 transmits to the MIDI cable 15 F8 data for incrementing the data memory pointer. If, however, the tempo clock data is indicative of zero, then F8 data is not produced. The MIDI cable 15 is connected to a MIDI-OUT terminal of the MIDI interface 14.

The sequencer 2 comprises a sequencer body 20 and a MIDI interface 21. The MIDI cable 15 is connected to a MIDI-IN terminal of the MIDI interface 21. In the internal play data memory of the sequencer body 2, play data as shown are stored in advance. The number of F8 data appearing between event data corresponds to an event interval in a score. The event data is composed, for example, note-on data (KON), tone pitch data (KCD) and key velocity or tone volume data (VEL). When the pointer has pointed to KON, these play data are sequentially output to the tone source 3.

With the foregoing arrangements, as the period between F 8 data gets shorter, play data is output from the sequencer 2 in such manner that the score time is caused to be shorter. Conversely, as the period between F8 data gets longer, play data is output from the sequencer 2 in such manner that the score time is caused to be longer.

Next, the function of the above-mentioned tempo controller 1 will be described with reference to FIGS. 2A through 2F.

Figure 2A:
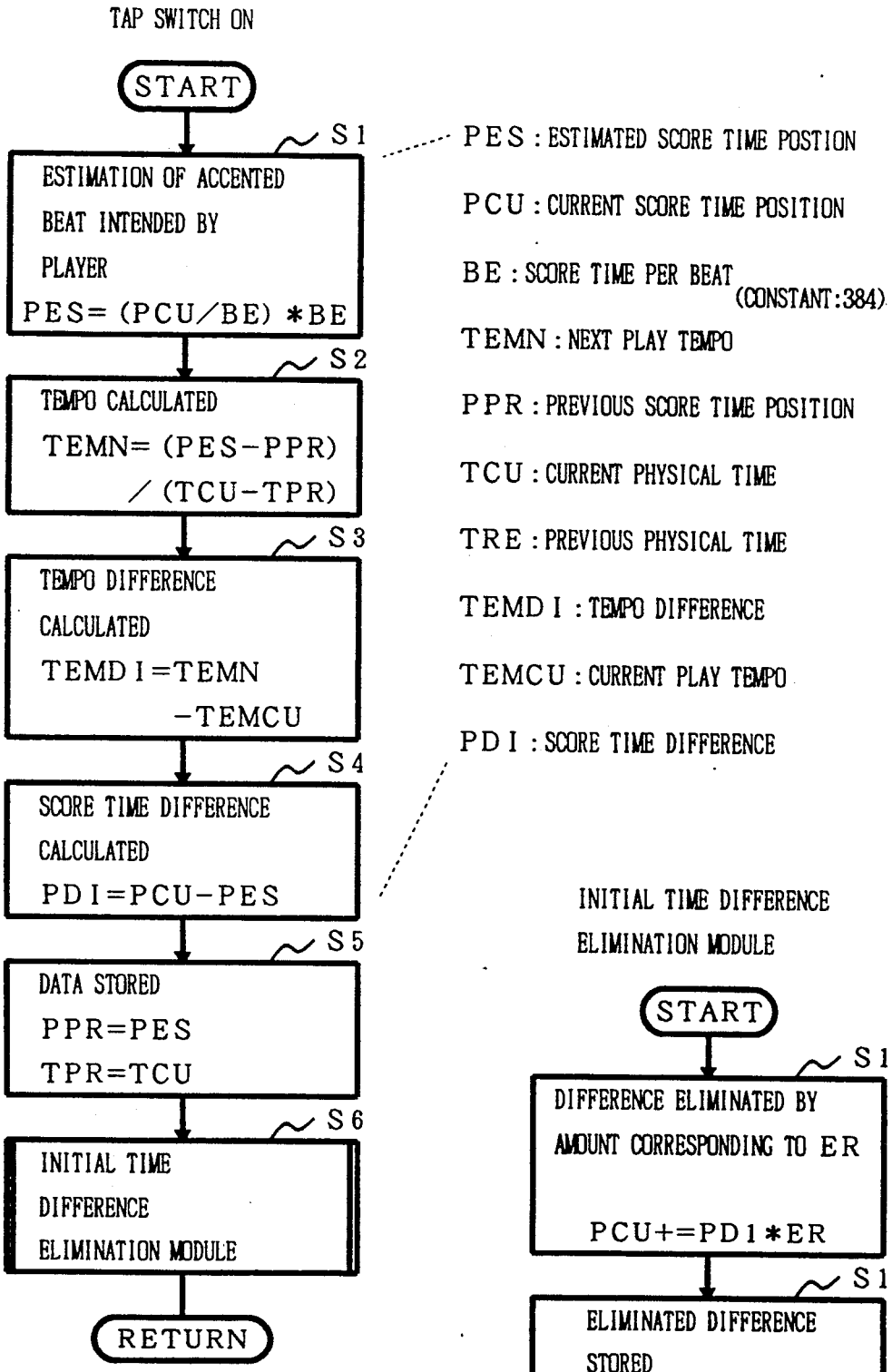
FIGS. 2A through 2F are flow charts illustrating an operational program for the tempo controller shown in FIG. 1.

FIG. 2A shows the function of the tempo controller 1 performed thereby when the tap switch 13 has been operated. In the illustrated flow, the tempo controller 1 functions to obtain a tempo difference as well as a score time difference and to partly eliminate or correct the score time difference.

Figure 3B:
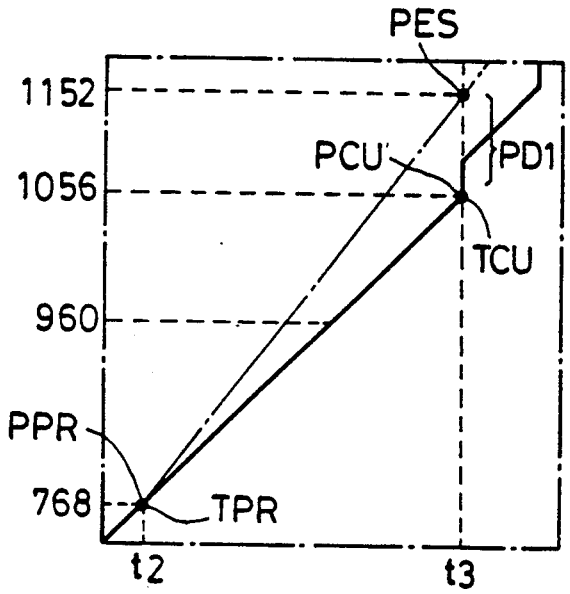
FIGS. 3A and 3B are diagrams explanatory of an example of the operation of the tempo controller.
Figure 3A:
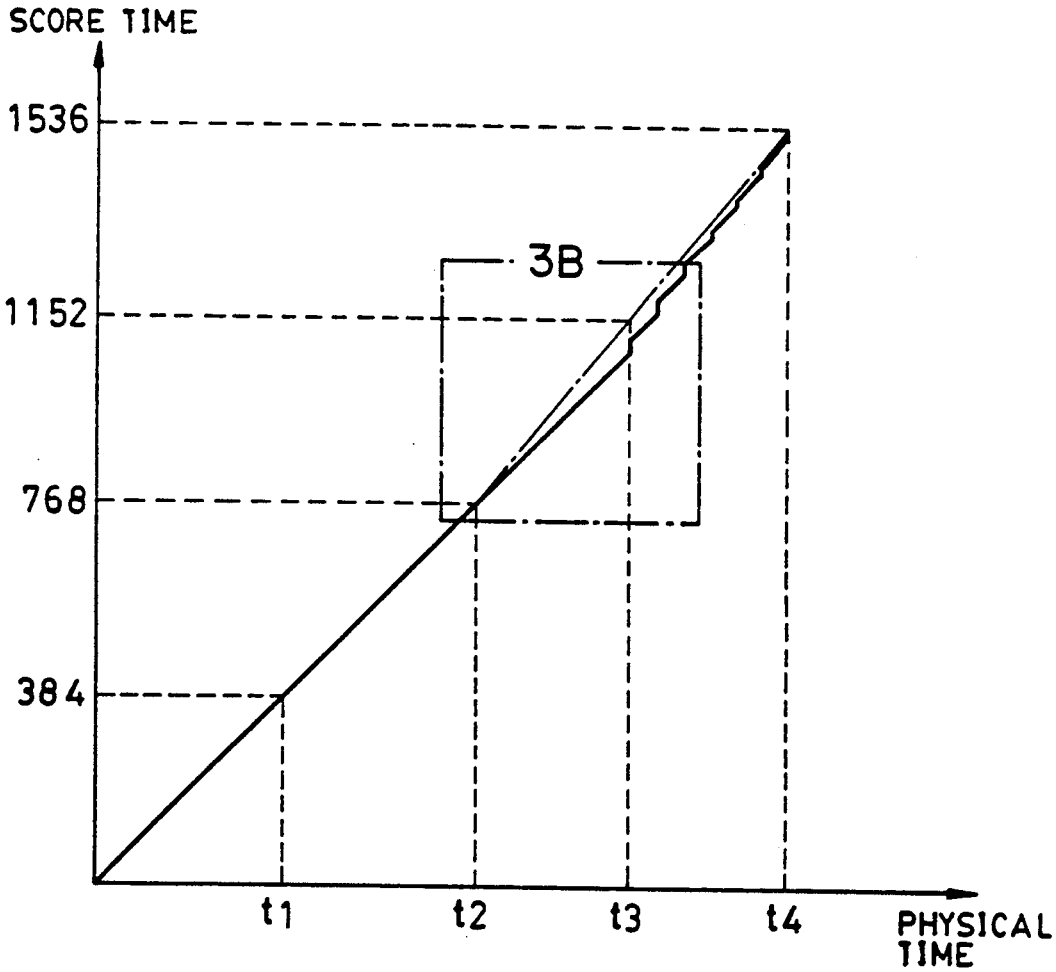

First of all, in step S1, estimation is made of a score time position of an accented beat which the player will make during his tapping action. The estimated score time position is represented by PES. In FIG. 3, if the current tap time is t3, then the estimated score time position PES is 1152. The estimated score time position is obtained by:

$$PES=(PCU/BE)*BE,$$

where PCU represents the current score time position, BE represents a score time of one beat, namely, 384, and asterisk * is a multiplication mark. If the current physical time is for example t3 in FIG. 3, the current score time position PCU is 1056. Further, in this embodiment, the quotient of (PCU/BE) is rounded. Accordingly, if the current physical time is t3, the estimated score time position PES is 1152 provided that the current score time position PCU is between 960 and 1152, and it is 768 provided that the current score time position PCU is between 768 and 959.

Since this embodiment is directed for eliminating a tempo difference in addition to a score time difference, a new tempo is calculated in the next step S2 as follows:

$$TEMN=(PES+PPR)/(TCU-TPR),$$

where TEMN represents a new play tempo to be effected thereafter, PPR represents the previous score time position, TCU represents the current physical time, and TPR represents the previous physical time. The new tempo, as apparent from FIG. 3, shows nothing but an inclination of the straight line. Subsequently, calculation of the tempo difference is performed in step S3 as follows:

$$TEMDI=TEMN-TEMCU,$$

where TEMCU represents the current tempo.

Then, the score time difference PDI is calculated in step S4 by:

$$PDI=PCU-PES$$

In the example shown in FIG. 3, the score time difference PDI is −96. Next, renewal of data is done in step S5, in which the estimated score time position PES is renewed as the previous score time position PPR and the current physical time TCU is renewed as the previous physical time TPR.

Figure 2B:
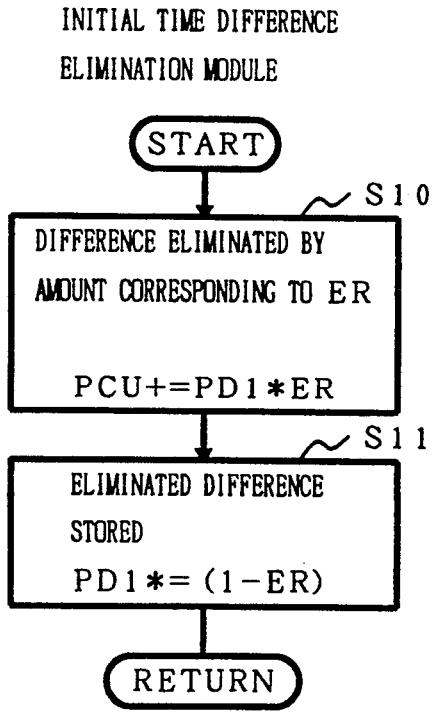
Figure 2C:
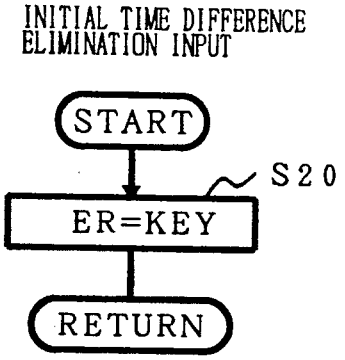

After the foregoing steps, an initial time difference elimination module is carried out in step S6. FIG. 2B is a flow chart showing such initial time difference elimination module, in which, of time difference produced at the time of tapping, difference amount to be immediately eliminated is obtained. A coefficient required for this purpose is a time difference elimination rate ER. In this first embodiment, the time difference elimination rate ER is previously input from the operation panel 11 as shown in FIG. 2C. The magnitude of the time difference elimination rate ER is set to be between 0 and 1. In step S10 of the initial time difference elimination module, the current score time position PCU is changed as follows by eliminating the time difference by the amount corresponding to the time difference elimination rate ER:

$$PCU+=PDI*ER$$

It is to be noted that the above equation is expressed in accordance with the notation method of the C language. The equation may be rewritten in normal mathematical expression as follows:

$$PCU=PCU+PDI*ER$$

Figure 4A:
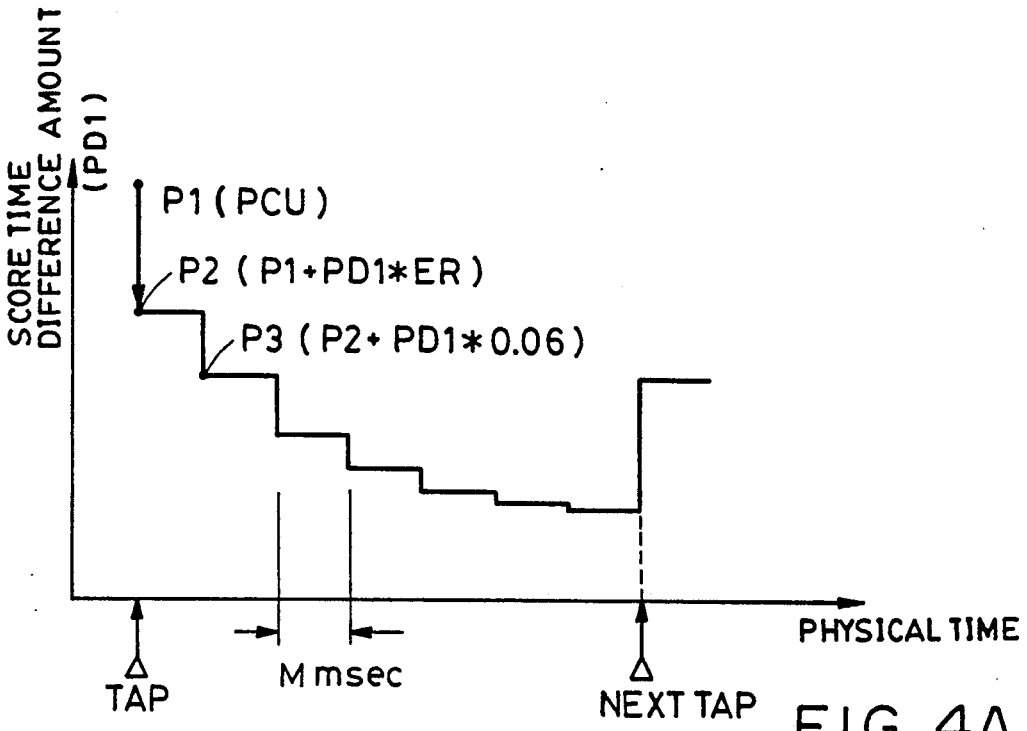
FIGS. 4A and 4B is a diagram explanatory of how the amount of score time difference and the amount of tempo difference varies.

It can be seen from FIG. 4A that, by the above equation, the current score time position PCU moves from P1 to P2 at the time of tapping.

Next, renewal of the time difference is carried out in step S11. Namely, the time difference can be renewed by:

$$PDI*=(1-ER)$$

Figure 2E:
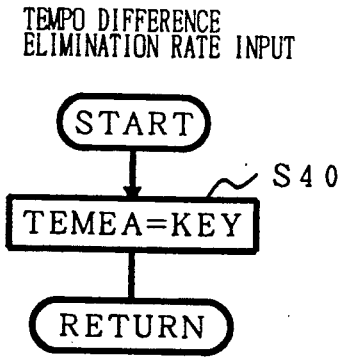
Figure 2D:
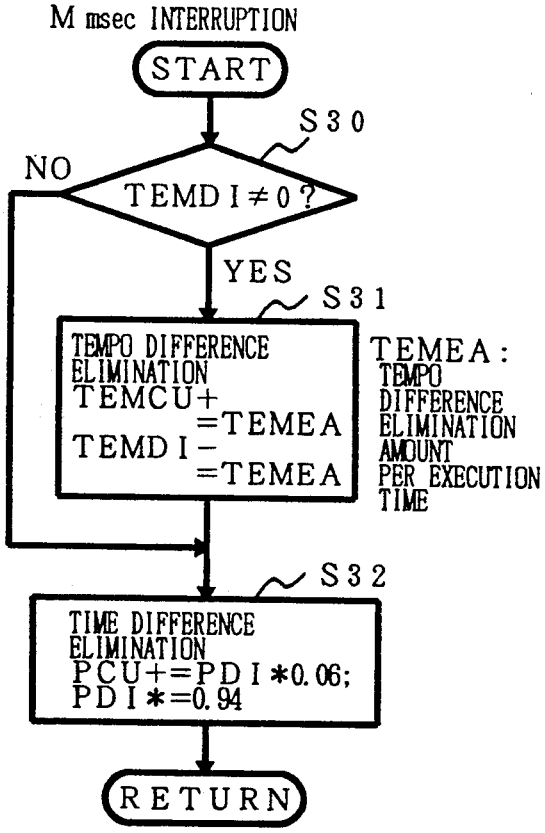

FIG. 2D is a flow chart showing a process to be carried out by timer interruption at an interval of M msec. In this flow, such process is performed that time difference and tempo difference are eliminated little by little after the tap switch has been turned on. In step S30, it is determined whether the tempo difference TEMDI is zero or not, and if the tempo difference TEMDI is zero, namely, if there is no tempo difference, step S32 is taken in which a time difference elimination step is performed. If, on the other hand, the tempo difference TEMDI is not zero, a tempo difference elimination step is performed in step S31, and then the time difference elimination step is performed in step S32.

The time difference elimination step is carried out using the following formula:

$$PCU+=PDI*0.06;$$

$$PDI*=0.094,$$

where 0.06 is a time difference elimination rate to be applied after the tap timing, this rate having been determined in advance. At the first execution time, the current score time position PCU moves from P2 to P3 in accordance with this formula, as shown in FIG. 4. Then, the score time position difference PDI is renewed in preparation for the next interruption.

Also, in the tempo difference elimination of step S31, the following formula is executed:

$$TEMCU+=TEMEA;$$

$$TEMDI-=TEMEA,$$

where TEMEA represents a tempo difference elimination amount for one execution time, the elimination amount TEMEA having been input in advance through the operation panel 11 as shown in FIG. 2E. Next, operation for eliminating the time difference is carried out in step S32.

Figure 4B:
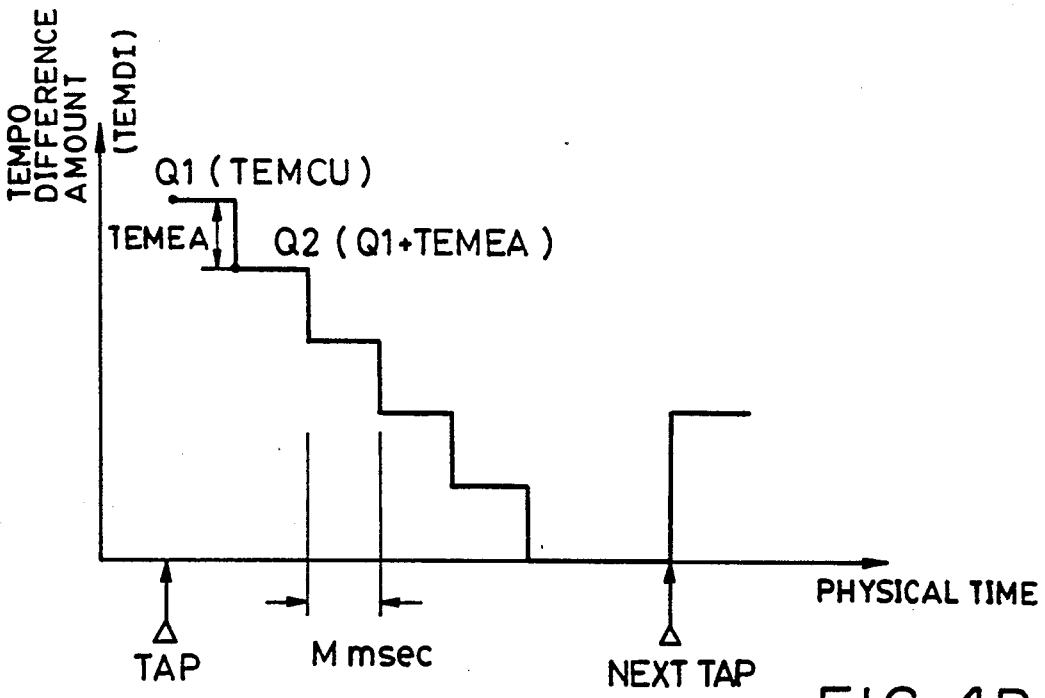

FIG. 4B illustrates current tempo change effected by the above-mentioned tempo elimination step (S31).

As shown in FIGS. 4A and 4B, respectively, the score time difference amount decreases in exponential function between taps, and the tempo difference amount decreases in primary function between taps.

Figure 2F:
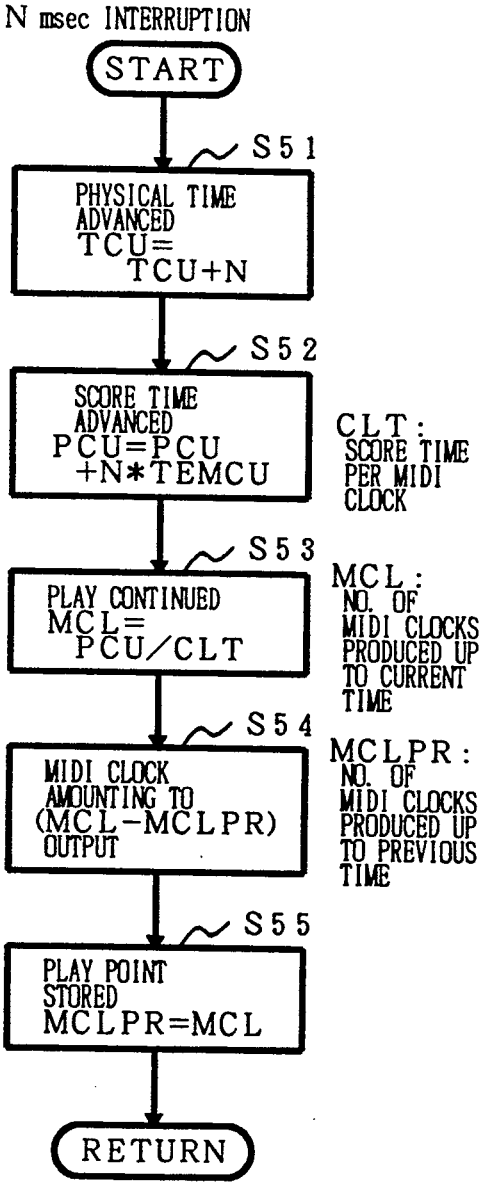

FIG. 2F is a flow chart executed by timer interruption at an interval of N msec. In this flow, MIDI data F8 to be used for incrementing the play data memory pointer is output to the MIDI cable.

In respective steps S51 and S52, advancement of the physical time and score time is done. That is, in step S51, the increased value N msec of the physical time is added to the current physical time TCU so as to advance the time TCU, and in step S52, the current play tempo TEMCU is multiplied by the change value N msec of the physical time to obtain a change value in the score time position which is then added to the current score time position PCU so as to advance the time position PCU. Then, the number of MIDI clocks MCL produced up to the current time is examined. Here, it is to be noted that the number of the MIDI clocks MCL is a number that is counted with resolution determined by the MIDI standard (count number for one beat is 24). The number of the MIDI clocks MCL produced up to the current time is obtained by:

$$MCL=PCU/CLT,$$

where CLT represents score time per MIDI.

Subsequently, in step S54, the number of MIDI clocks, i.e., the number of F8 data to be output through the MIDI cable is obtained by:

$$(MCL-MCLPR),$$

where MCLPR represents the number of MIDI clocks produced up to the previous time. If this interruption flow is executed, for example, at an interval of 5 msec, then the number of MIDI clocks (F8 data) is "0" or "1"; that is, it is considered that it quite frequently becomes "0" and rarely becomes "1" in the case of a normal play on a score.

Next, in step S55, MCLPR=MCL is executed to make preparations for the next processing, and then the flow returns to the main routine.

With the above-mentioned function, followability of automatic play output with respect to tapping can be improved if the initial time difference elimination rate (ER) is set to a large value. Conversely, if the initial time difference elimination rate is set to a small value, smoothness can be improved. The trade-off between such smoothness and followability can be selected as the player desires. In addition, because arrangements are made in the embodiment for eliminating the tempo difference as well, the followability can be improved even more effectively.

Now, another embodiment of the invention will be described.

Figures 5, 6A, 6B:
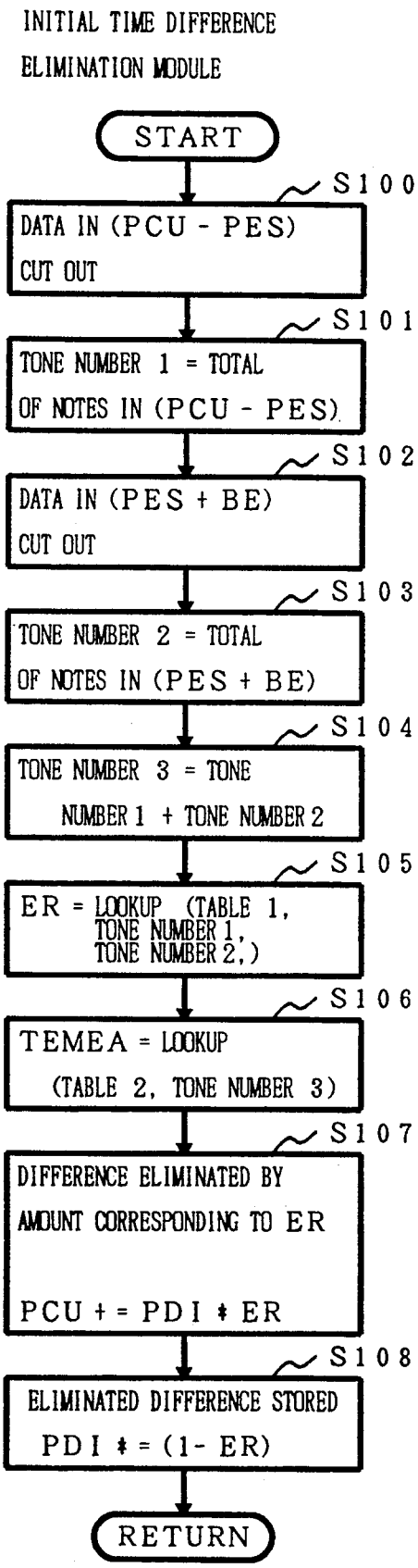
FIG. 5 is a flow chart showing another embodiment of the initial time difference elimination module shown in FIG. 2A.
FIGS. 6A and 6B show example tables used in the module of FIG. 5.
Figure 7:
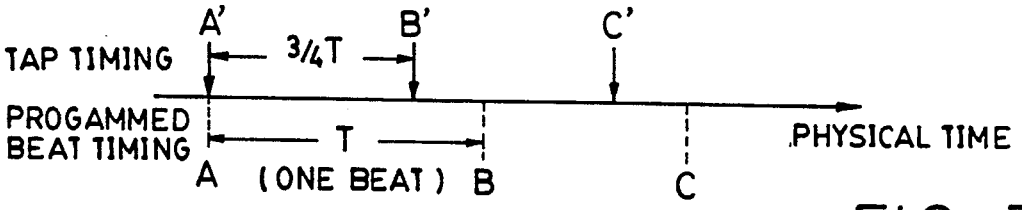
FIG. 7 is a timing chart explaining how the difference results between a score time in a computer and a tap timing.
Figure 9A:
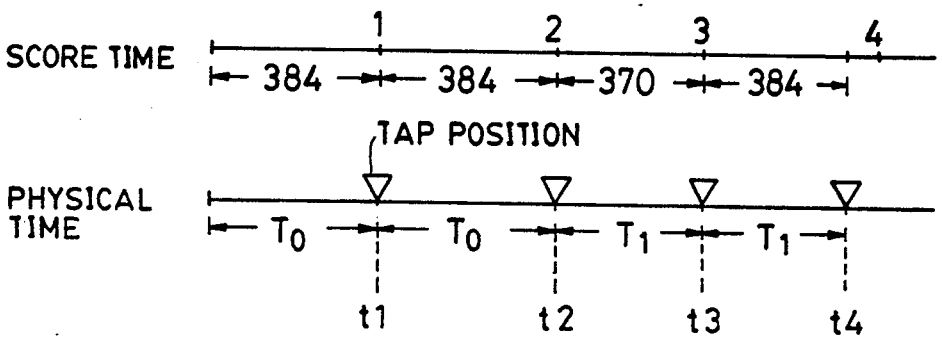
FIGS. 9A and 9B are diagrams explanatory of the example shown in FIG. 7 in terms of score time and physical time.
Figure 9B:
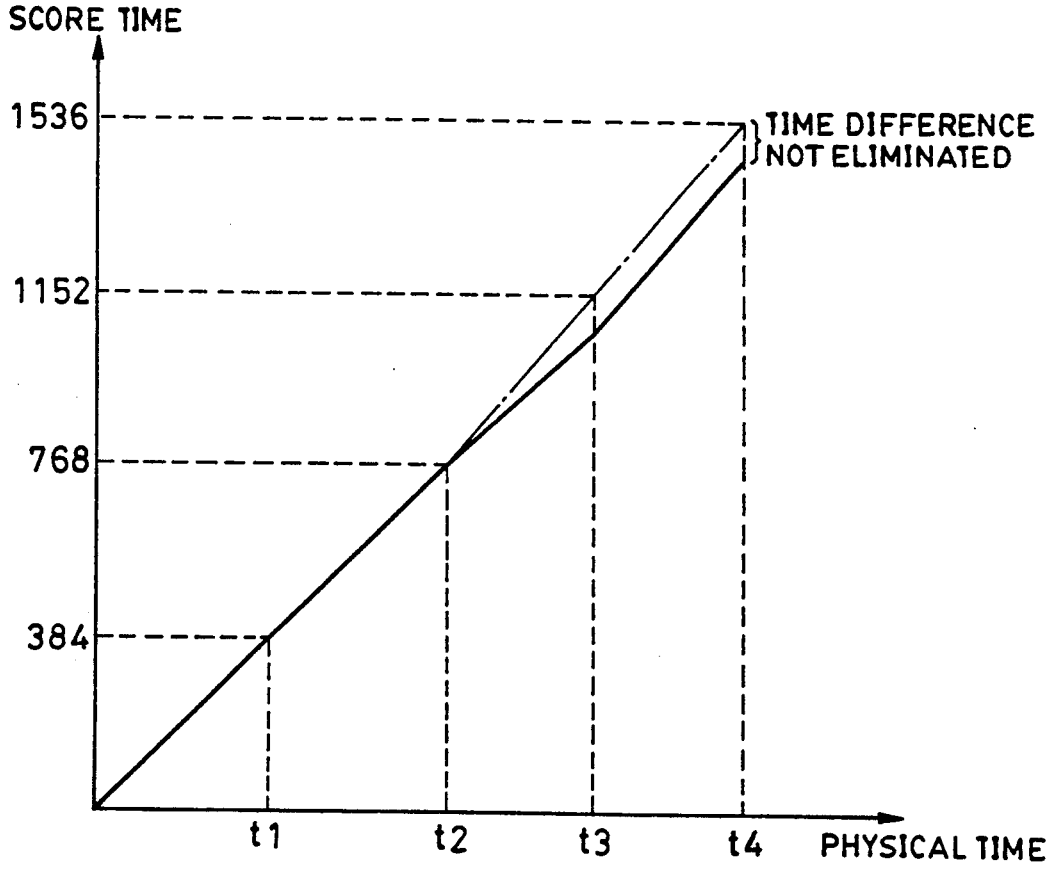
Figure 8:
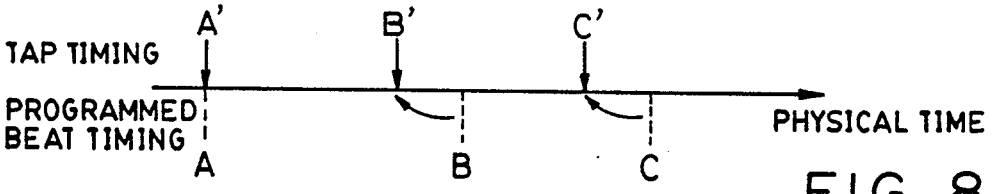
FIG. 8 is a timing chart explanatory of a prior art applied for eliminating the difference.
Figure 10A:
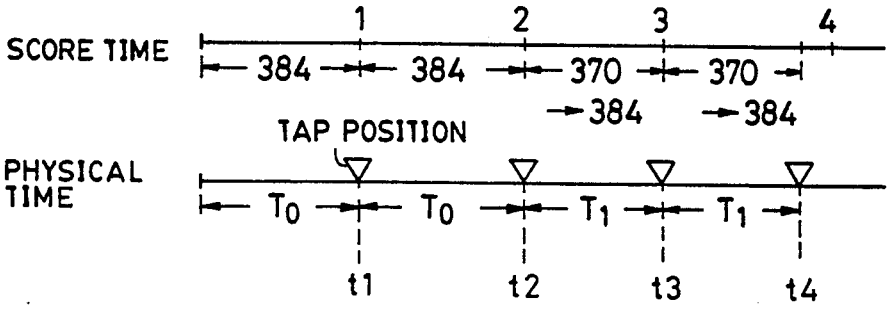
FIGS. 10A and 10B are diagrams explanatory of the example shown in FIG. 8 in terms of score time and physical time.
Figure 10B:
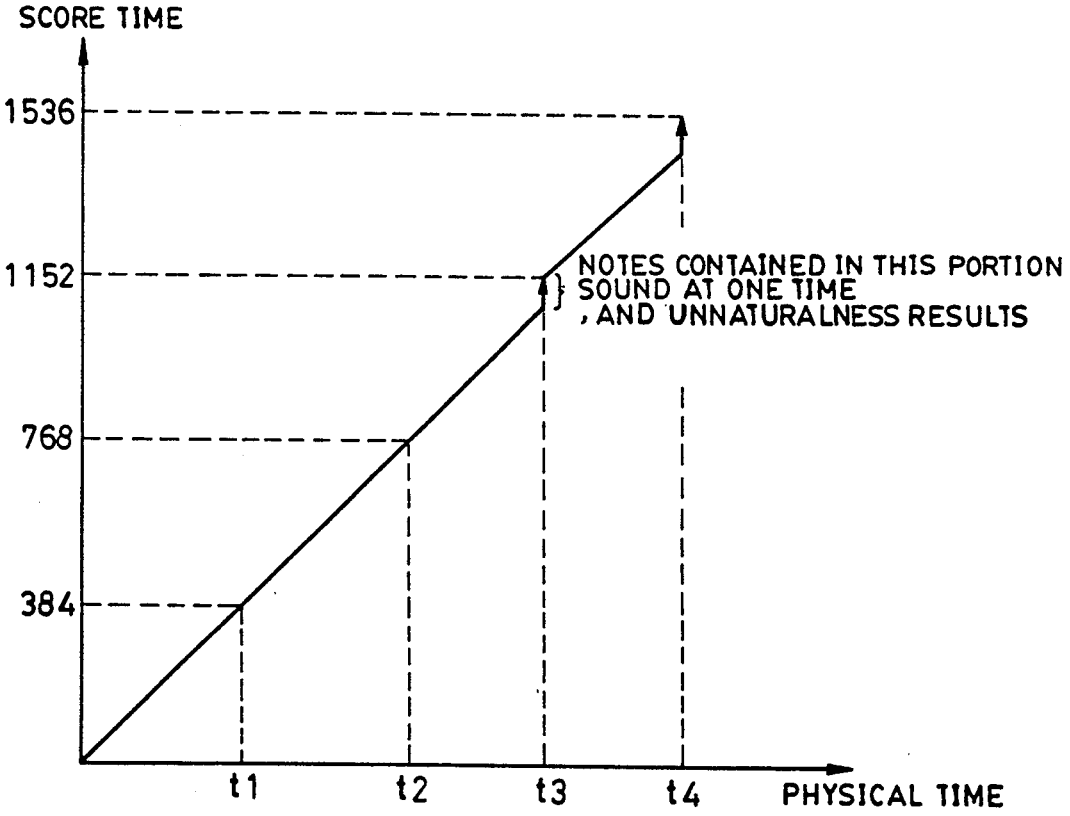

FIG. 5 is a flow chart showing another example of the initial time difference elimination module. In this example, of time difference produced at the time of tapping, difference amount to be immediately eliminated is obtained, and also, tempo difference elimination amount for one execution time is determined in preparation for subsequent tempo difference elimination process.

A coefficient required for determining score time elimination amount is a time difference elimination rate ER. This elimination rate ER is obtained in steps beginning with step N100. First, data in (PCU−PES) are cut out. Namely, note data are taken in which are contained from the score time position at which the system has been playing, to the score time intended by the player. The total of these note data taken in is made tone number 1 (step S101). Next, data in (PES+BE) are cut out. Namely, note data are taken in which are contained within one beat from the tap timing. The total of these data taken in is made tone number 2 (step S103). The tone number 2 is used for correction. In step S104, the tone numbers 1 and 2 are added into tone number 3. The tone numbers land 2 are parameters indicative of the density of notes contained in the neighborhood of the score time position at the time of tapping. Subsequently, the time difference elimination rate ER is obtained from a table, using LOOKUP function based on the tone numbers 1 and 2 (S105). FIG. 6A shows this table TBL1.

In this flow, tempo difference elimination amount for one execution time is obtained in step S106. More specifically, tempo difference elimination amount TEMEA for one execution time is obtained from a table, using LOOKUP function based on the tone number 3. FIG. 6B shows this table TBL2.

After the above-mentioned steps have been completed, in a time difference elimination module of step S107, the estimated score time position PES is changed as follows by eliminating the time difference by the amount corresponding to the rate ER:

$$PCU+=PDI*ER$$

With this formula, the current score time moves from P1 to P2 as shown in FIG. 4A.

Next, the time difference is renewed in step S108. Namely, it can be renewed by:

$$PDI*=(1-ER)$$

In similar manner to the above-mentioned, timer interruption is executed at an interval of M msec in the embodiment of FIG. 5, in accordance the flow chart of FIG. 2. Thus, function is carried out for eliminating the time difference and tempo difference little by little. However, as TEMEA (time difference elimination amount for one execution time) that is used in the operation in the tempo difference elimination of step S31, the elimination amount obtained in step S106 of FIG. 5 is utilized.

Further, similarly to the above-mentioned, in the case of the embodiment of FIG. 5, the score time difference amount decreases in exponential function between taps, and the tempo difference amount decreases in primary function, as shown in FIGS. 4A and 4B.

In this second embodiment, it is important that the magnitude of movement occurring initially from P1 to P2 and then from Q1 to Q2 varies in accordance with, that is, depending on the note density in the neighborhood of the score time position at the tap timing. In the embodiment, the more the tone numbers 1 and 2 are, namely, the greater the note density is, the smaller become the elimination rate and the tempo difference elimination amount TEMEA, so that the amount of movement from P1 to P2 and from Q1 to Q2 becomes smaller. In other words, jump of tones and tempo change can be restrained. Conversely, if the tone numbers 1 and 2 get smaller, namely, as the note density gets coarse, restraint of the jump of tones and of the tempo change is limited, and rather, the difference comes to be eliminated to greater degree.

Also in the embodiment of FIG. 5, the timer interruption process at an interval of N msec.is performed in accordance with the flow of FIG. 2F. With this process, the value of the initial time difference elimination rate (ER) changes depending on the density of notes contained in the neighborhood of the score time position at the time of tapping. When the note density in the neighborhood of the score time position at the time of tapping is large, the value of the initial time difference elimination rate (ER) becomes small so that jump of tones can be prevented. Conversely, when the note density in the neighborhood of the score time at the time of tapping is small, the value of the elimination rate (ER) becomes large so that the score time difference may be eliminated at a relatively high speed. In the latter case, the jump of tones is not in the appreciable degree because of the small note density.

Thus, the magnitude of the initial time difference elimination rate is, in general, balanced in view of the relationship between the jump of tones and the time difference elimination amount, but because this elimination rate is determined using the note density as a parameter, its value can be quite suitable for the play state. In addition, since tempo difference is also eliminated in the embodiment, the above-mentioned follawability can be improved even more effectively.

Although the tone numbers 1 and 2 are shown as parameters indicative of density of notes contained in the neighborhood of a score time position at the time of tapping, only the tone number 1 may be used.

Although score time difference is, as shown in FIG. 4A, eliminated in exponential function in the above-mentioned embodiments, it may of course be eliminated in primary function.

Similarly, tempo difference can also be decreased in a desired function. Further, the value of 0.06 which is used as a constant for eliminating the time difference at an interval of M msec in step S32 of FIG. 2D may be established as desired. With respect to the score time difference elimination, although, in the second embodiment, initial time difference elimination rate is determined depending on note density, the constant in step in S32 may be made a variable that varies in correspondence with the above-mentioned note density.

As has been described so far, according to the present invention, automatic play output provided during tapping operation is allowed to smoothly follow a tap made by the player. In addition, since function parameters which determine the decrease rate of score time difference amount can be determined as desired by the player, the player can establish as desired the follawability and characteristics of smooth time change in conformity with a specific piece of music; for example, the player can increase the initial elimination rate for immediately eliminating the difference in response to tapping if the follawability is to be improved. If, on the hand, smoothness is to be improved, he decreases the initial elimination rate. In this manner, for each piece of music, it becomes possible to realize optimum time change of play output following a tap.

According to another aspect of the invention, score time difference amount is determined in accordance with the density of notes contained in the neighborhood of a score time position at the time of tapping, and thus it becomes possible to obtain follawability suitable for the actual play conditions. Moreover, because elimination amount of tempo difference is also determined in accordance with the note density, follawability can be made even more suitable for the actual play conditions.

What is claimed is:

1. A tempo controller which comprises:

means for producing tempo information to set a tempo for automatic play;

tapping means for performing a tap operation;

tempo controlling means for controlling the tempo information in correspondence with a tap operation performed by said tapping means;

score time advancing means for advancing a current score time indicative of a current score position in the automatic play at a tempo corresponding to the tempo information;

score time difference detecting means for detecting a difference between a current score time at a time of a tap operation performed by said tapping means and a score time of a beat point corresponding to the time of the tap operation, and current score time controlling means for performing a control for progressively changing the current score time so that the score time difference detected by said detecting means is eliminated.

2. A tempo controller as defined in claim 1, wherein said score time difference detecting means includes means for determining a score time of a beat point that is closest to the time of the tap operation performed by said tapping means, and calculating a difference between a determined score time and the current score time at the time of the tap operation.

3. A tempo controller as defined in claim 1, wherein said current score time controlling means performs the control to progressively change said current score time in accordance with a predetermined function.

4. A tempo controller as defined in claim 3, which further includes means for variably setting a parameter of said function.

5. A tempo controller as defined in claim 1, wherein said tempo controlling means determines a new tempo based on a time interval between the tap operations and it controls the tempo information in correspondence with a determined new tempo.

6. A tempo controller as defined in claim 5, wherein said tempo controlling means controls said tempo information in such manner that a tempo is progressively changed from a current tempo to the determined new tempo.

7. A tempo controller as defined in claim 1, which further includes a note density detecting means for detecting a density of notes contained in a predetermined score range of the automatic play including a current score time position in the automatic play at the time of the tap operation, and wherein said current score time controlling means performs the control to progressively change said current score time with a characteristic corresponding to a detected note density.

8. A tempo controller as defined in claim 7, wherein said said note density detecting means includes means for detecting a number of notes contained between the current score time position at the time of the tap operation and the score time position of the beat point closest to said time of the tap operation.

9. A tempo controller as defined in claim 7, wherein said note density detecting means includes means for detecting a number of notes contained within a score time range predetermined on the basis of the current score time position at said time of the tap operation.

10. A tempo controller as defined in claim 7, wherein said tempo controlling means determines a new tempo based on an interval between the tap operations and it controls said tempo information in such manner that a tempo is progressively changed from the current tempo to a determined new tempo with a characteristic corresponding to the detected note density.

11. A tempo controller which comprises:

means for producing tempo information to set a tempo for automatic play;

means for performing a tapping operation;

means for controlling said tempo information in correspondence with said tapping operation so that said tempo is progressively changed from a first tempo to a second tempo when tempo changes are to be made; and note density detecting means for detecting a density of notes contained in a predetermined score range of the automatic play including a current score time position in the automatic play at the time of a tap action performed by said tapping means, and wherein said tempo controlling means controls the tempo information in such a manner that a tempo is progressively changed with a changing characteristic corresponding to a note density detected by said note density detecting means.

* * * * *